US005379697A

United States Patent [19]

Ertl

[11] Patent Number: 5,379,697

[45] Date of Patent: Jan. 10, 1995

[54] PRINTING MACHINE

[75] Inventor: Wolfgang Ertl, Parkstein, Germany

[73] Assignee: BHS Druck- und Veredelungstechnik GmbH, Weiherhammer, Germany

[21] Appl. No.: 116,693

[22] Filed: Sep. 7, 1993

[30] Foreign Application Priority Data

Sep. 7, 1992 [DE] Germany ..... 4229352

[51] Int. Cl.[6] ..... B41F 23/04

[52] U.S. Cl. ..... 101/424.1; 101/487

[58] Field of Search ..... 101/424.1, 487; 39/4, 39/41, 13, 62, 151

[56] References Cited

U.S. PATENT DOCUMENTS

| | | | |
|---|---|---|---|
| 1,650,339 | 11/1927 | Fischer | 101/424.1 X |
| 2,000,684 | 5/1935 | Allen et al. | 101/424.1 X |
| 2,704,382 | 3/1955 | Kreidl | 101/487 X |
| 3,960,081 | 6/1976 | Gustavs et al. | 101/424.1 |
| 5,115,741 | 5/1992 | Rodi | 101/424.1 |

FOREIGN PATENT DOCUMENTS

| | | | |
|---|---|---|---|
| 0206366 | 11/1959 | Austria | 101/424.1 |
| 8805176U1 | 7/1988 | Germany . | |
| 2608661B2 | 8/1988 | Germany . | |

OTHER PUBLICATIONS

Klein, Hugo, "Aluminiumfolie in der Verarbeitungsindustrie (IV)", DE-Z Papier +Kunststoff-Verarbeitier Jul. 1973.

*Primary Examiner*—Edgar S. Burr
*Assistant Examiner*—Christopher A. Bennett
*Attorney, Agent, or Firm*—Browdy and Neimark

[57] ABSTRACT

A printing machine structured in modular design, in particular a flexo printing machine, has a printing unit on a stand, on which printing unit a web in particular of a plastic foil or a metal foil is printed with color curing under UV radiation. A UV radiation and cooling unit is arranged on the stand and has a cooling cylinder and at least one UV radiator. The web surrounds the cooling cylinder at a great angle of contact.

7 Claims, 2 Drawing Sheets

PRINTING MACHINE

BACKGROUND OF THE INVENTION

1. Field Of The Invention

The invention relates to a printing machine, in particular a flexo printing machine.

2. Background Art

Printing machines of the generic type which are of modular design may be used as single color printing machines or as multicolor printing machines when arranged successively. Each individual printing machine is a unit.

Printing machines of the generic type are primarily structured as flexo printing machines, but they may also be gravure or offset printing machines.

Since the conventional flexo or gravure or offset printing colors contain solvents of which the removal from the outgoing air implies high expenditure, colors have meanwhile been used tentatively that cure under UV radiation, i.e. they contain neither water as a solvent nor any chemical solvents and they cure under UV radiation by a chemical reaction.

Colors of the type curing under UV radiation are reported to have been used for label printing in the offset process. The printed side of the labels, on a carrier web, is guided past UV radiators. Cooling blinds had been provided on the other side of the carrier web.

Also with so-called central cylinder machines it is known to arrange UV radiators between the printing units resting against the central cylinder. This does not give satisfying results.

SUMMARY OF THE INVENTION

It is the object of the invention to embody a printing machine of modular design, in particular a flexo printing machine, in which the use of colors curing under UV radiation is possible and in which these colors are reliably cured in the printing machine without the risk of distortion of the web when delicate web materials are used, for example plastic foils or thin metal foils.

This object is attained in a printing machine comprising a stand, a printing unit, in particular a flexo printing unit, arranged on the stand and provided with an applicator for color curing under UV light, deflection pulleys for feeding of a web to be printed, in particular a web of a metal foil or a plastic foil, in the direction of the web towards the printing unit and for the discharge of the printed web from the printing unit, and a UV radiation and cooling unit having a cooling cylinder along the outer circumference of which the web is guidable and which has at least one UV radiator arranged at a little distance from the outer circumference of the cooling cylinder.

It can be ensured by the cooling of the web on the cooling cylinder that plastic foils do not shrink and metal foils do not get distorted. The registration is maintained, which is of great importance in particular for the use of the printing machine as a module of multicolor printing machines. Also, the curing time of the colors can be favorably influenced by means of the cooling cylinder, the latter being operatable with heatable water, i.e. with water of a temperature higher than the ambient temperature but still having a cooling effect on the web. Several radiators can be arranged in modular organization around the cooling cylinder. In this regard, too, modular design is possible. Consequently, there is also the possibility of adaptation to different web speeds.

Further favorable features, advantages and details of the invention will become apparent from the claims and the following description of an exemplary embodiment of the invention taken in conjunction with the drawing.

DESCRIPTION OF THE PREFERRED EMBODIMENT

Figure 1:
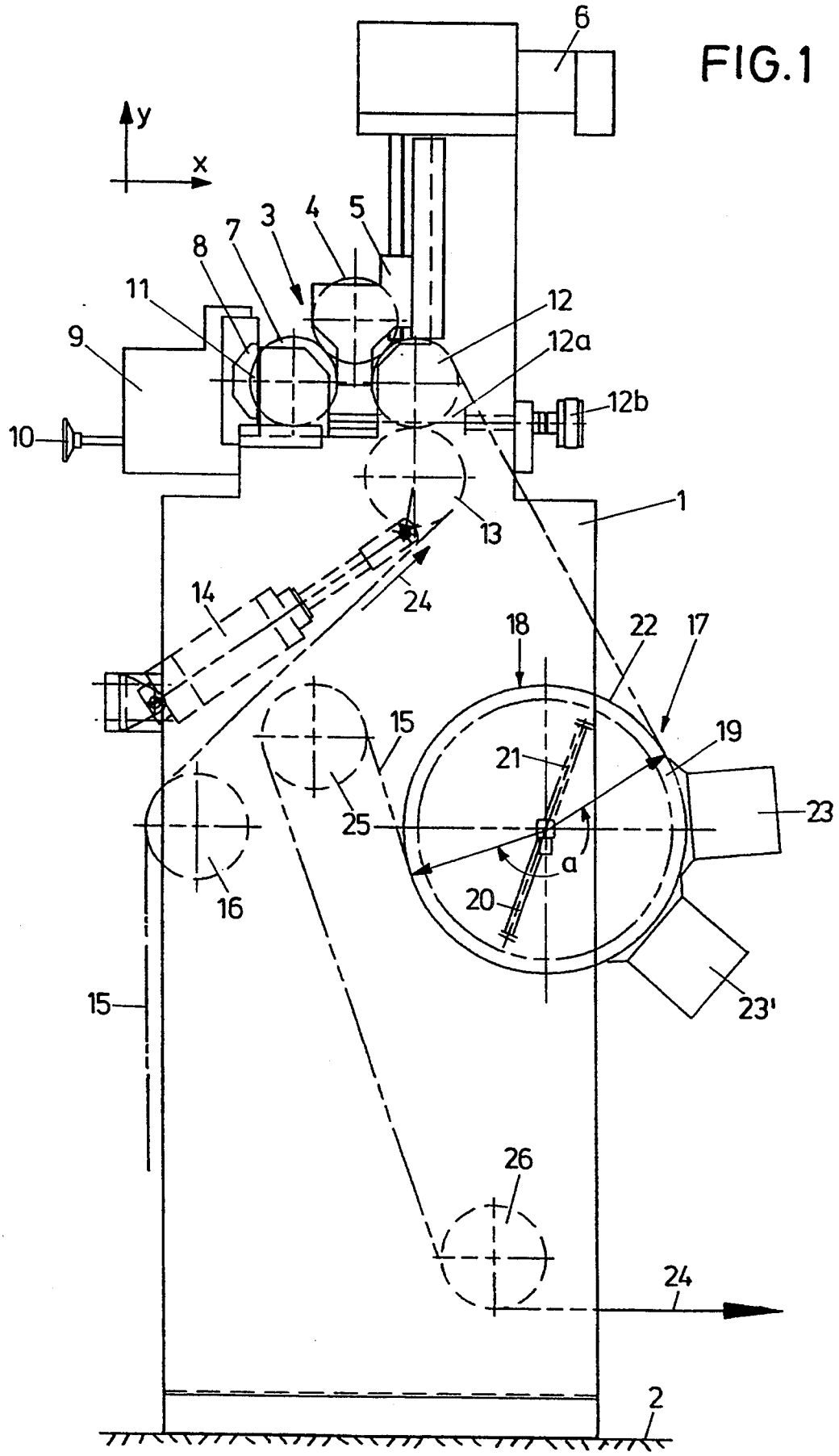
FIG. 1 is a diagrammatic side view of a printing machine.

The printing machine illustrated in FIG. 1 has a stand 1 supported on the ground 2. In the upper part of the stand a printing unit 3 is arranged which is a flexo printing unit in this case. The printing unit 3 has a printing form (or impression) cylinder 4 with a printing form arranged on it. The printing form cylinder 4 is conventionally driven by a motor, not shown. It is supported on a vertically movable y-carriage 5 which is vertically displaceable by means of a carriage drive motor 6 and which is in particular adjustable downwards in the vertical line.

The printing form cylinder 4 rests against a grid (or transfer) cylinder 7 which, together with a so-called chamber ductor 8, is horizontally displaceably arranged on an x-carriage 9. The displacement or adjustment takes place by means of a handwheel 10. The chamber ductor 8 is a known device shaped as a flat cap and closely resting against the cylindrical surface of the grid cylinder 7. Color printing material such as ink, herein also denoted as "color", is fed into the interior space 11 between the chamber ductor 8 and the grid cylinder 7 and is transferred from the grid cylinder 7 to the printing form arranged on the printing form cylinder 4.

The printing form cylinder 4 again rests against a counter-pressure cylinder 12. By means of an actuator **12*b*, the grid cylinder 7 is adjustable on a carriage 12*a* in the x direction, i.e. in the horizontal line, against the printing form cylinder 4. An adjusting cylinder 13 presses from below against the counter-pressure cylinder 12. By means of an adjusting drive 14 formed as a hydraulically actuatable piston-cylinder drive, the adjusting cylinder 13 is moved into the position shown in FIG. 1 where it bears against the counter-pressure cylinder 12**, or out of this position into a downwards oriented position. As far as specified in the foregoing, the flexo printing machine is fundamentally known.

From a reel, not shown, the printing unit 3 is supplied with a web 15 of material to be printed, such as metal foil, plastic foil, paper, or metallized paper, via a deflection pulley 16 supported on the stand. This web 15 is as usually piloted through the printing unit 3, where it is printed with color which cross-links under the influence of UV radiation, i.e. it passes from the fluid into the solid and permanent condition. Such printing colors are known. They contain photoinitiators which cause the mentioned cross-linking under the influence of UV radiation. There is no conventional drying by evaporation or vaporization of fluid such as solvents, water or the like.

The printed web 15 is fed from the printing unit 3 to a UV radiation and cooling unit 17. The latter consists of a cooling cylinder 18 supported on the stand 1 and having an interior cooling jacket 19 which is in turn connected to a cooling water flow pipe 20 and a cooling water return pipe 21. UV radiators 23, 23' are arranged at a little distance from the outer circumference 22 of the cooling cylinder 18; they are successively arranged in the direction 24 of the web—as seen in FIG. 1. The cooling cylinder 18 can be driven in the direction 24 of the web by means of a drive, not shown. The web 15 is guided along another deflection pulley 25 arranged on the stand 1 such that the angle of contact $\alpha$ of the web 15 with the cooling cylinder 18 is comparatively great. In the present case, the angle of contact is slightly more than 180°. From there, the web 15 is guided to a deflection pulley 26 which is located in the lower portion of the stand 1 and via which the web 15 is guided out of the stand 1.

Figure 2:
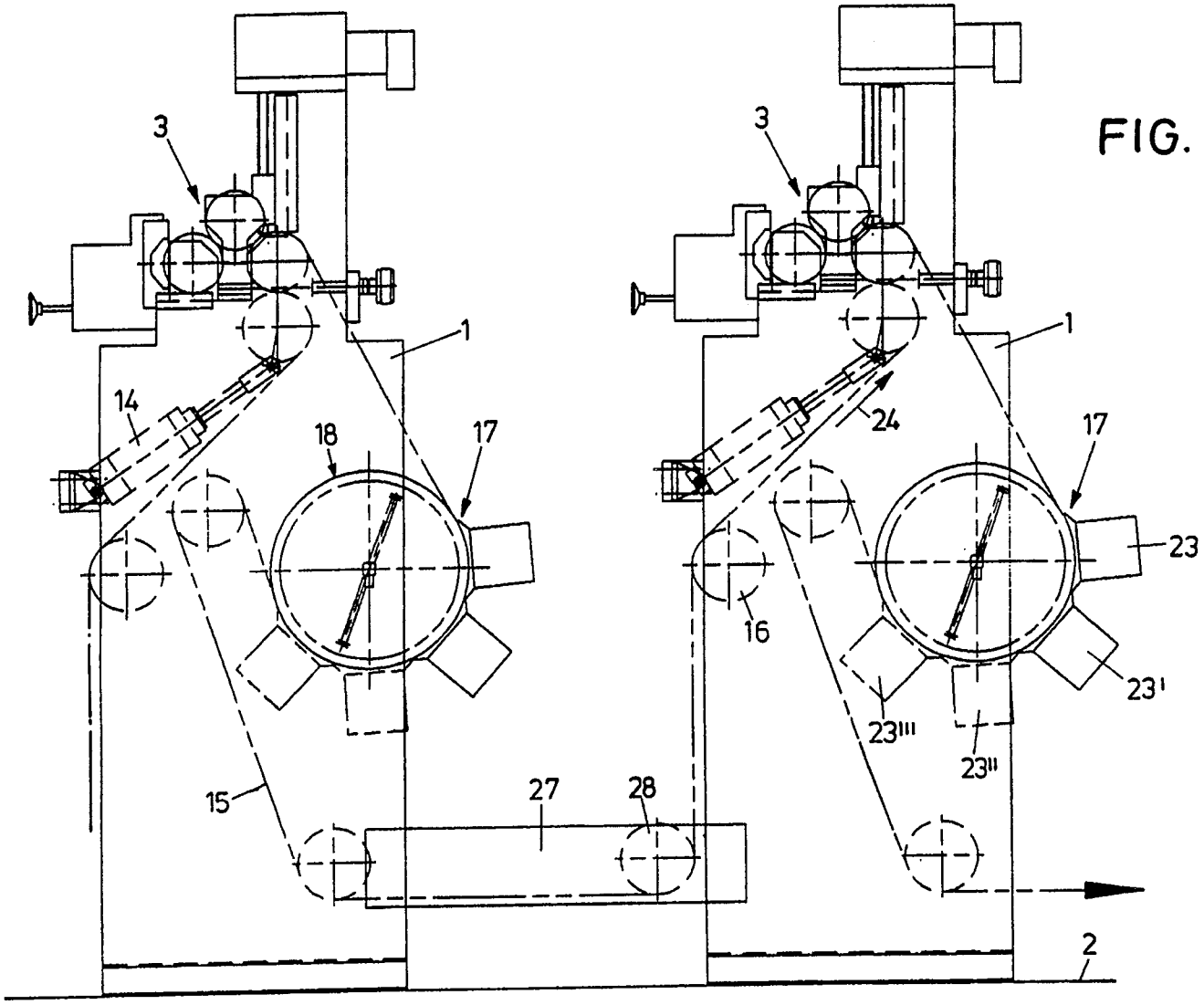
FIG. 2 shows two printing machines successively combined to form a multicolor printing machine.

If—as seen in FIG. 2—several printing machines each forming a module are joined together successively in the direction 24 of the web to form a multicolor printing machine, then two adjacent stands 1 are connected with each other spaced apart by a traversing member 27, a deflection pulley 28 being arranged in this traversing member 27 via which pulley the web 15 is guided to the deflection pulley 16.

As seen in FIG. 2, several UV radiators can be provided as required. Here, too, modular design is possible. Instead of the two UV radiators 23, 23' of FIG. 1, the exemplary embodiment according to FIG. 2 has four UV radiators 23, 23', 23'', 23''' arranged on each printing unit successively in the direction 24 of the web on the stand 1.

As a result of this option of providing a greater or smaller number of UV radiators 23, 23', 23'', 23''', the UV radiation applied per time unit to the web 15 and thus to the color thereon per surface unit complies with the actual requirements. In particular with differing web speeds, i.e. differing printing speeds, this allows simple adaptation to the required radiation performance. The web 15 is heated also under UV radiation. Therefore, provision is made for tile cooling by means of the cooling cylinder 18. Here, too, the choice of the temperature of the cooling water, which may be slightly pre-heated in relation to ambient conditions, serves to achieve optimal cooling of the web 15, the great angle of contact in particular ensuring a long cooling path referred to the direction 24 of the web. Intensive cooling is especially important for the printing of plastic foils or very thin metal foils, in particular very thin aluminium foils, since the mentioned foils lose their dimensional stability under the influence of heat. Plastic foils can shrink; metal foils can expand or get distorted.

As seen in the drawing, cooling cylinders 18 of different diameters can be used making the length of the effective cooling surface and the surface along which to use UV radiators controllable.

Each printing machine is a unit where not only tile printing takes place but also the complete curing of tile color which cures under ultraviolet light. The unprinted side of the web 15 will be guided along the outer circumference 22 of the cooling cylinder 18, while its printed side faces the UV radiators 23, 23', 23'', 23'''.

What is claimed is:

1. A web printing machine comprising:

a stand (1) having a plurality of radiator mounting sites;

a printing unit (3) mounted on the stand (1) and provided with an applicator (8) for applying a UV light-curing ink to a web (15);

deflection pulleys (16, 26, 28) for transporting the web (15) selectively toward and away from the printing unit (3) generally in a direction of transport (24);

a UV radiation and cooling unit (17) including a cooling cylinder (18) and at least one UV radiator (23, 23', 23'', 23'''), the cooling cylinder (18) having an outer circumference (22) along which the web (15) is guidable when printed, the UV radiation and cooling unit (17) being connected to a cooling water flow pipe (20) and a cooling water return pipe (21), said at least one UV radiator being demountably disposed upon the stand (1) at one of said plurality of modular radiator mounting sites, said mounting sites being deployed along the direction of transport (24), said at least one UV radiator being disposed at a small distance from the outer circumference (22) of the cooling cylinder (18).

2. The printing machine according to claim 1, wherein a plurality of the UV radiator (23, 23', 23'', 23''') are successively disposed at corresponding locations of the plurality of modular radiator mounting sites.

3. The printing machine according to claim 1, wherein the web (15) is disposed about the cooling cylinder (18) so as to make contact with the cooling cylinder (18) around an angle of at least 180 degrees.

4. A UV radiation and cooling unit adapted for use with a web press for printing UV-curing inks on a web, the UV radiation and cooling unit comprising:

a cooling cylinder (18) having a surface;

deflection pulleys (16, 26, 28) and the cooling cylinder for wrapping the web over the surface about the cooling cylinder through a wrapping angle;

a radiator mounting site adjacent the surface of the cooling cylinder;

a UV radiator (23, 23', 23'', 23'''), adapted for mounting on the mounting site, for radiating with UV the portion of the web wrapped over the surface of said cooling cylinder; and cooling means in said cooling cylinder for cooling the web by removing heat from the cooling cylinder.

5. The UV radiation and cooling unit according to claim 4, wherein the cooling means includes water flow means for circulating water within the cooling cylinder.

6. The UV radiation and cooling unit according to claim 4, further including a plurality of the modular radiator mounting site, the plurality radially deployed about the cooling cylinder.

7. The UV radiation and cooling unit according to claim 4, wherein the wrapping angle is greater than 180 degrees.

* * * * *